US007387599B1

(12) United States Patent
Hsu

(10) Patent No.: US 7,387,599 B1
(45) Date of Patent: Jun. 17, 2008

(54) MASSAGING BODY-GYM APPARATUS

(76) Inventor: Yan Hsu, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 11/772,826

(22) Filed: Jul. 3, 2007

(51) Int. Cl.
*A63B 21/00* (2006.01)
*A63B 21/02* (2006.01)
*A61H 15/00* (2006.01)

(52) U.S. Cl. ..... 482/132; 482/122; 482/126; 601/118

(58) Field of Classification Search ..... 482/122, 482/126, 132, 106–108, 907; 601/118–120, 601/62, 72, 134, 135
See application file for complete search history.

(56) References Cited

U.S. PATENT DOCUMENTS 1,560,549 A * 11/1925 Duncan ..... 601/120
2,577,129 A * 12/1951 Johnston et al. ..... 601/118
2,920,418 A * 1/1960 Britt ..... 446/241
3,938,803 A * 2/1976 Wilmoth et al. ..... 482/132
4,519,605 A * 5/1985 Leland ..... 482/92
4,606,539 A * 8/1986 Farnham ..... 482/148
4,945,900 A * 8/1990 Masuda ..... 601/120
5,411,460 A * 5/1995 Karlson et al. ..... 482/112
6,203,476 B1 * 3/2001 Wang et al. ..... 482/121
6,398,694 B1 * 6/2002 Bountourakis ..... 482/44
6,629,913 B2 * 10/2003 Chen ..... 482/129
7,291,101 B2 * 11/2007 Deal ..... 482/126
2006/0235343 A1 * 10/2006 Fitzmaurice ..... 601/131

* cited by examiner

*Primary Examiner*—LoAn H. Thanh
*Assistant Examiner*—Allana Lewin

(57) ABSTRACT

A massaging body-gym apparatus is composed of a rod, at least two rollers, two positioning sleeves, two sealing covers and an elastic rope. A positioning device is installed in the roller, composed of a pair of half positioning bases and a positioning bar. The positioning sleeve has a blocking disc bored with a restricting hole for inserted by the positioning bar. With the positioning bar inserted in or separated from the restricting hole of the positioning sleeve, the roller can be positioned immovably or released to rotate freely, so that, combined with different postures, various parts of a human body can be exercised or massaged. In addition, the present invention is small and light, handy for carrying.

4 Claims, 14 Drawing Sheets

MASSAGING BODY-GYM APPARATUS

BACKGROUND OF THE INVENTION

1. Field of the Invention

This invention relates to a massaging body-gym apparatus, particularly to one having a massaging function, and possible to be carried around conveniently.

2. Description of the Prior Art

As more and more people are getting civilization diseases, health care is deemed much by people. Exercise may be absolutely a simplest and most important method for it, so there are a lot of commercial massage tools for relieving physical sore and pain, and body gym apparatuses for bodybuilding. However, the massage tools or the body-gym apparatus can only provide single function. Different parts of a body need a diversity of body-gym apparatuses and massaging devices have to be extra prepared for relieving physical sore and pain. That means a user has to spend a great deal of money to purchase them and prepare a large space to place them. Moreover, they are always too big to be easily carried.

SUMMARY OF THE INVENTION

The objective of this invention is to offer a massaging body-gym apparatus for exercising and massaging a body.

The main characteristics of the invention are a rod, at least two rollers, two positioning sleeves, two sealing covers and an elastic rope. The rod is provided with plural massaging bodies respectively having a plurality of massaging particles, a blocking rim formed near its two ends respectively, and a through hole bored outside the blocking rim. The rollers are mounted on the rod and respectively provided with plural through holes. The positioning sleeve is mounted at two ends of the rod respectively, provided with a through hole and a blocking disc located at its one end. The sealing covers are respectively connected to two ends of the rod. The elastic rope has its two ends respectively connected to two ends of the rod.

The present invention is characterized by that a positioning device is installed in one of the through holes of each roller, provided with a pair of half positioning bases and a positioning bar, and the blocking disc of the positioning sleeve is provided with a restricting hole to be inserted by the positioning bar.

BRIEF DESCRIPTION OF DRAWINGS

This invention is better understood by referring to the accompanying drawings, wherein.

DETAILED DESCRIPTION OF THE PREFERRED EMBODIMENT

Figure 1:
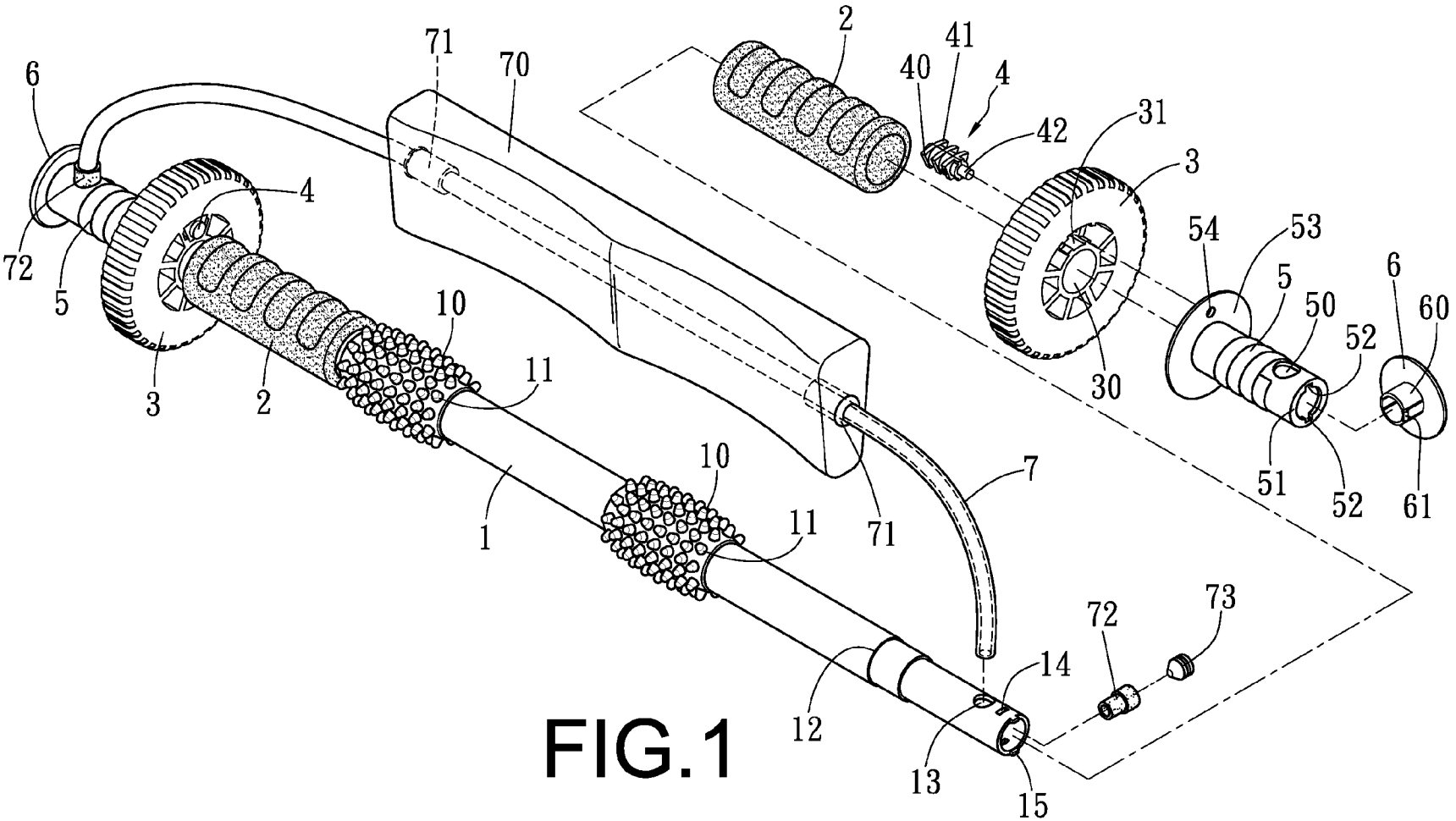
FIG. 1 is an exploded perspective view of a preferred embodiment of a massaging body-gym apparatus in the present invention.

As shown in FIGS. 1-5, a preferred embodiment of a massaging body-gym apparatus in the present invention is composed of a rod 1, two grips 2, two rollers 3, two positioning devices 4, two positioning sleeves 5, two sealing covers 6 and an elastic rope 7.

The rod 1 is a hollow tube, provided with two massaging bodies 10 that are integrally formed together with the rod 1 and respectively provided with plural particles 11, a blocking rim 12, a through hole 13 and two locking holes 14 orderly formed near its two ends respectively, and two projections 15 formed at its two ends respectively.

Each of the grips 2 is mounted around the rod 1 to be adjacent to the outer end of the massaging body 10, made of flexible materials.

Figure 2:
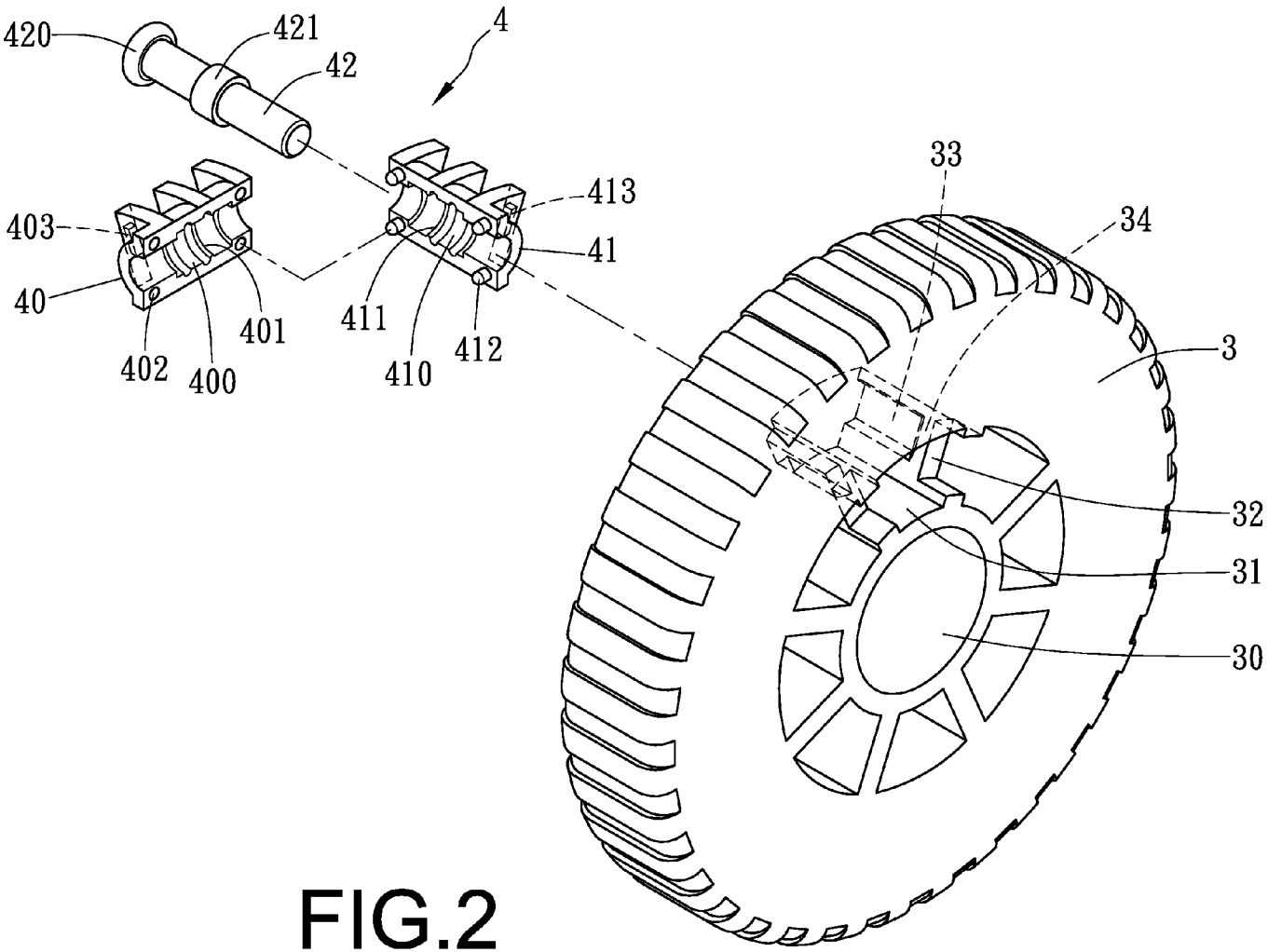
FIG. 2 is an exploded perspective view of a roller and a positioning device of the preferred embodiment of a massaging body-gym apparatus in the present invention.
Figure 3:
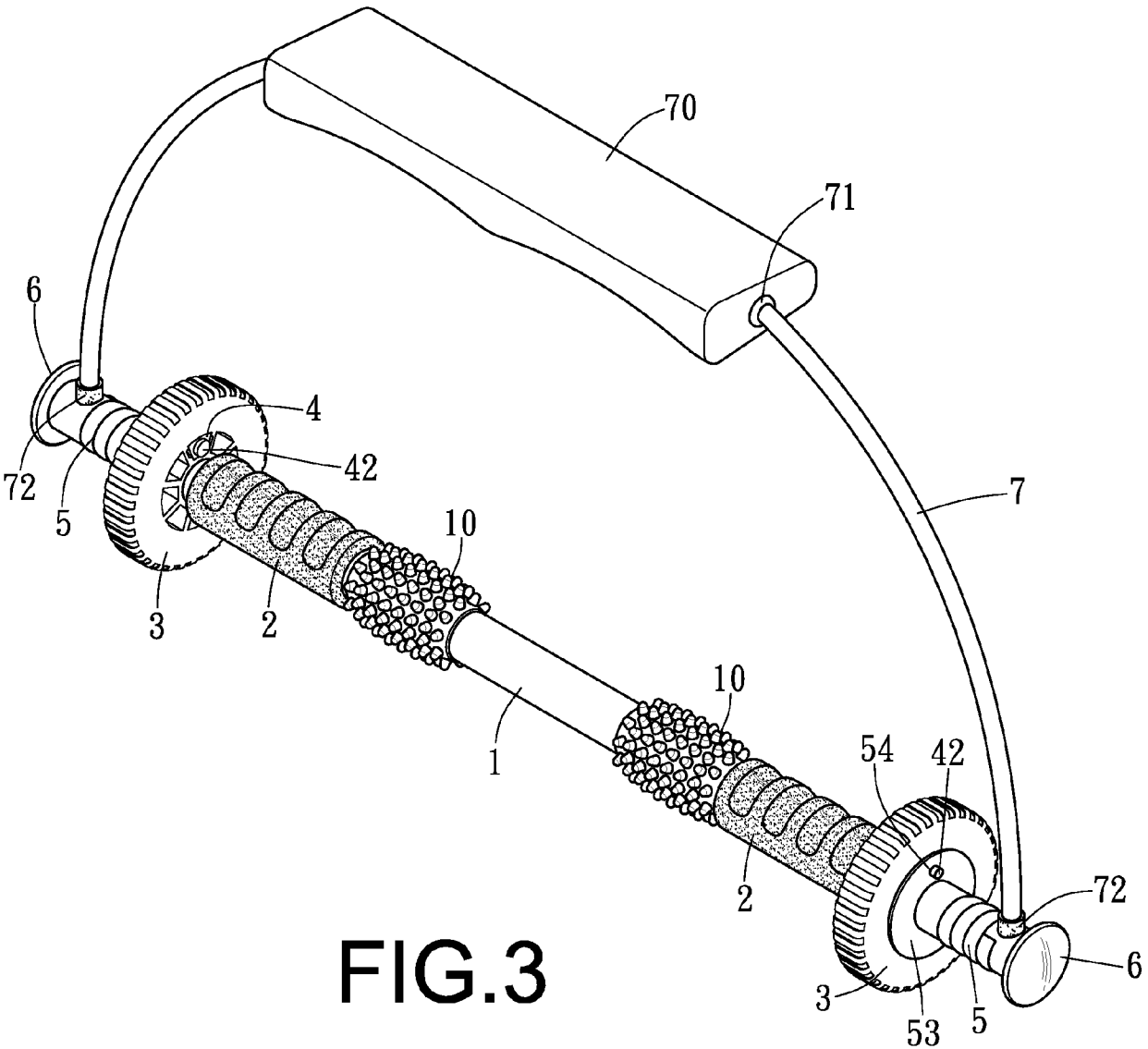
FIG. 3 is a perspective view of the preferred embodiment of a massaging body-gym apparatus in the present invention.
Figure 5:
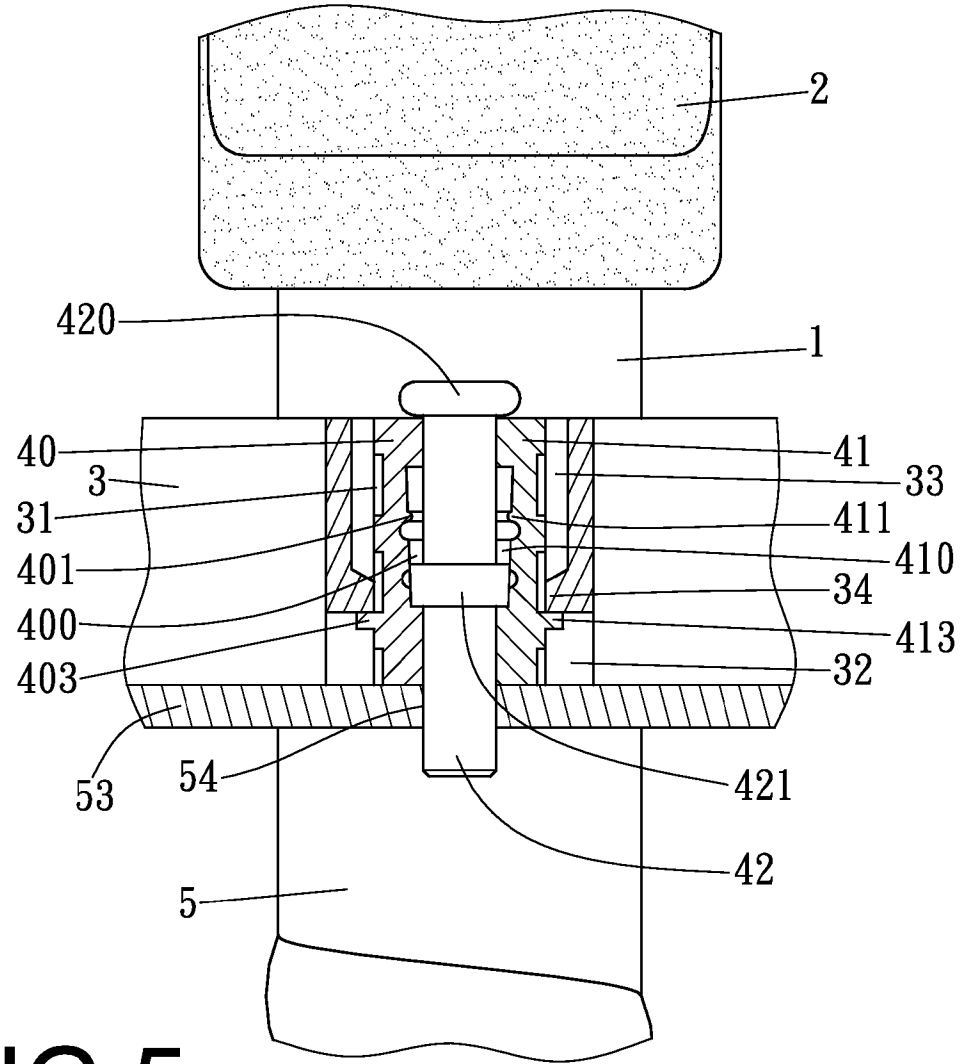
FIG. 5 is a partial cross-sectional view of the preferred embodiment of a massaging body-gym apparatus in the present invention, showing a combination of the roller and the positioning device.

Each of the rollers 3 is installed near two ends of the rod 1 respectively, provided with a shaft hole 30, plural through holes 31, and a recess 32 formed respectively at two sides of one end of one of the through holes 31 as shown in FIGS. 2 and 5. The roller 3 is in addition provided with a sliding groove 33 formed respectively at two sides of the other end of the through hole 31 and corresponding to the recess 32, and a blocking edge 34 located between the sliding groove 33 and the recess 32.

Each of the positioning devices 4, as shown in FIG. 2, is assembled in one of the through holes 31 of the roller 3, provided with a pair of half positioning bases 40 and 41 that are to be connected as a whole component, and a positioning bar 42. The positioning bases 40 and 41 are respectively provided with a sliding groove 400 and 410 formed inside them with a conical surface, and a semi-annular rim 401 or 411 located inside the sliding groove 400 or 410. The half base 40 is provided with plural connecting holes 402 bored on its inner edge and the other half base 41 is provided with plural connecting projection 412 extended from its inner edge. The half positioning bases 40 and 41 are also respectively provided with a positioning pin 403 or 413 located on their outer surfaces. A positioning bar 42 is wrapped by the half positioning bases 40 and 41 and able to move therein, provided with one end 420 having a larger diameter, and a blocking rim 421 formed around its intermediate portion to be positioned in the sliding grooves 400 and 410.

Each of the positioning sleeves 5 is gloved at two ends of the rod 1 respectively, provided with a through hole 50, an annular rim 51 formed at its one end, two recesses 52 cut at the annular rim 51 and equidistantly spaced apart, a blocking disc 53 located at its inner end, and a restricting hole 54 bored on the blocking disc 53.

Each of the sealing covers 6 is connected to two ends of the rod 1 respectively, provided with a connecting portion 60 formed at its one side, and two locking projections 61 formed at the connecting portion 60 to exactly face each other.

The elastic rope 7 has its two ends connected to two ends of the rod 1 respectively, provided with a supporting cushion 70, a sleeve 71 located at two ends of the supporting cushion 70 respectively, a soft jacket 72 and a block 73 to be fixed with its two ends respectively.

Figure 4:
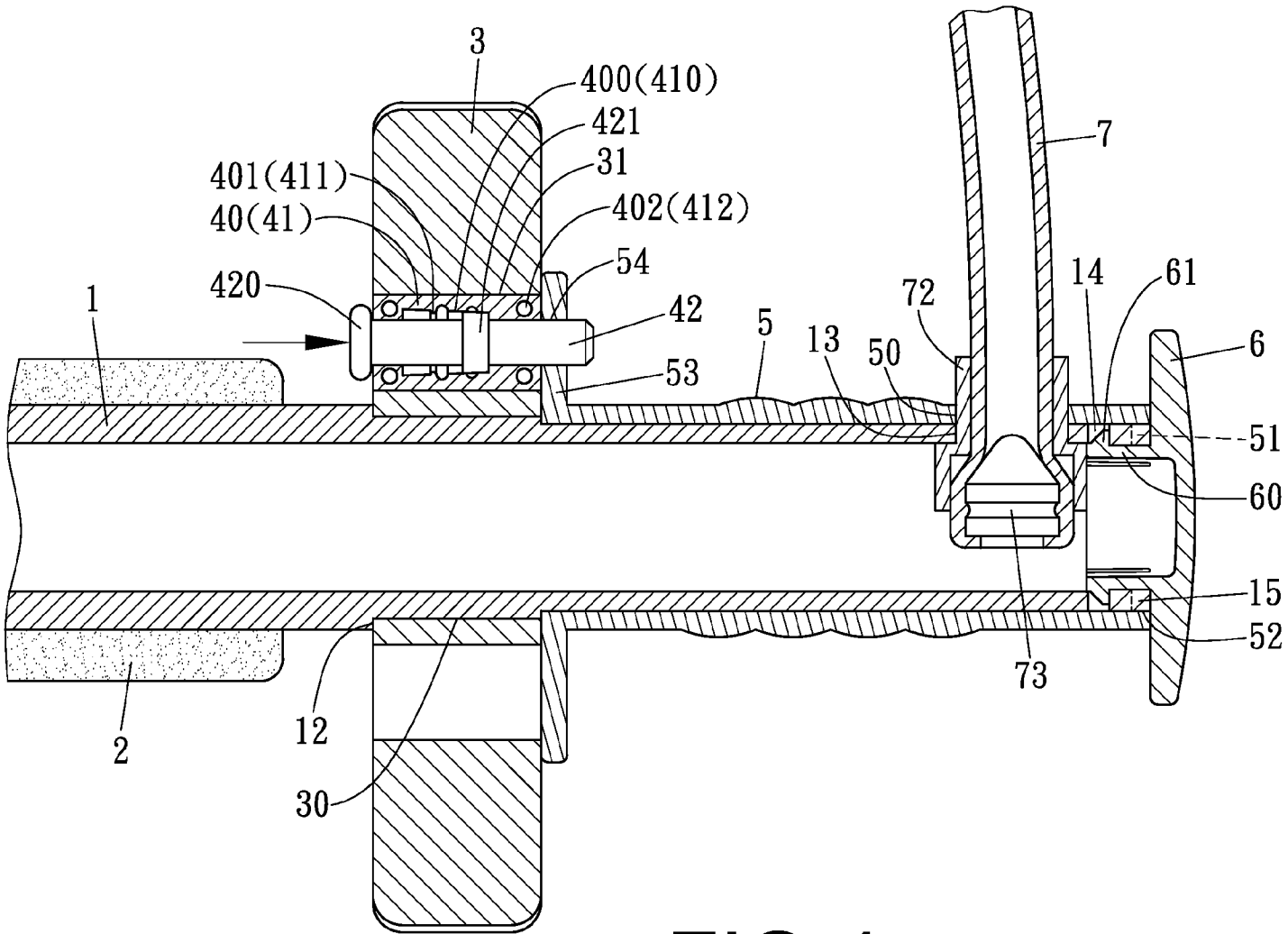
FIG. 4 is a partial magnified cross-sectional view of the preferred embodiment of a massaging body-gym apparatus in the present invention.

In assembly, as shown in FIGS. 1-5, first, put the grips 2 through the rod 1 to be positioned next to the massaging bodies 10 and force the positioning devices 4 respectively to be fitted in one of the through holes 31 of each of the rollers 3, keeping the positioning pins 403 and 413 restricted by the blocking edges 34 and the half positioning bases 40 and 41 tightly engaged with the through holes 31, so that the positioning devices 4 are stably fixed in the through holes 31 of the rollers 3. The positioning bars 42 are extended out of one side of the rollers 3. The rollers 3 are then respectively mounted on two ends of the rod 1 to keep their one side leaning against the blocking rims 12 and positioned thereof, as shown in FIG. 4. Next, the positioning sleeves 5 are respectively worn on one end of the rod 1, keeping the roller 3 positioned between the blocking rim 12 and the positioning sleeve 5, with the projection 15 of the rod 1 engaged in the recess 52 of the annular rim 51 of the positioning sleeve 5, and with the through hole 50 of the positioning sleeve 5 facing against the through hole 13 of rod 1. The roller 3 is blocked by the blocking disc 53 of the positioning sleeve 5 and the positioning bar 42 extended outside the roller 3 is restricted in the restricting hole 54 of the positioning sleeve 5. Next, insert two ends of the elastic rope 7 respectively through the through hole 50 and 13 and pulled out of one end of the rod 1. Each end of the elastic rope 7 is further inserted in the jacket 72, and then the block 73 is squeezed into the jacket 72 and wrapped by the end of the elastic rope 7, as shown in FIG. 4, so that the block 73 is not to be separated from the elastic rope 7. The jacket 72 is then pulled back into the rod 1 and fitted in the through holes 13 and 50. Being blocked by the jacket 72 and the block 73, the elastic rope 7 is not to be released from the through hole 13. Therefore, the jacket 72 can protect the elastic rope 7 directly contacting with the through holes 13 and 50, for keeping the elastic rope 7 from broken because of the abrasion created between the elastic rope 7 and the through holes 13 and 50 while pulling the elastic rope 7. Finally, via keeping the connecting portion 60 of the sealing cover 6 inserted and locked in the locking holes 14 of the rod 1, the sealing cover 6 is connected with the end of the rod 1 to keep the positioning sleeve 5 and the roller 3 positioned steadily on the rod 1.

Figure 6:
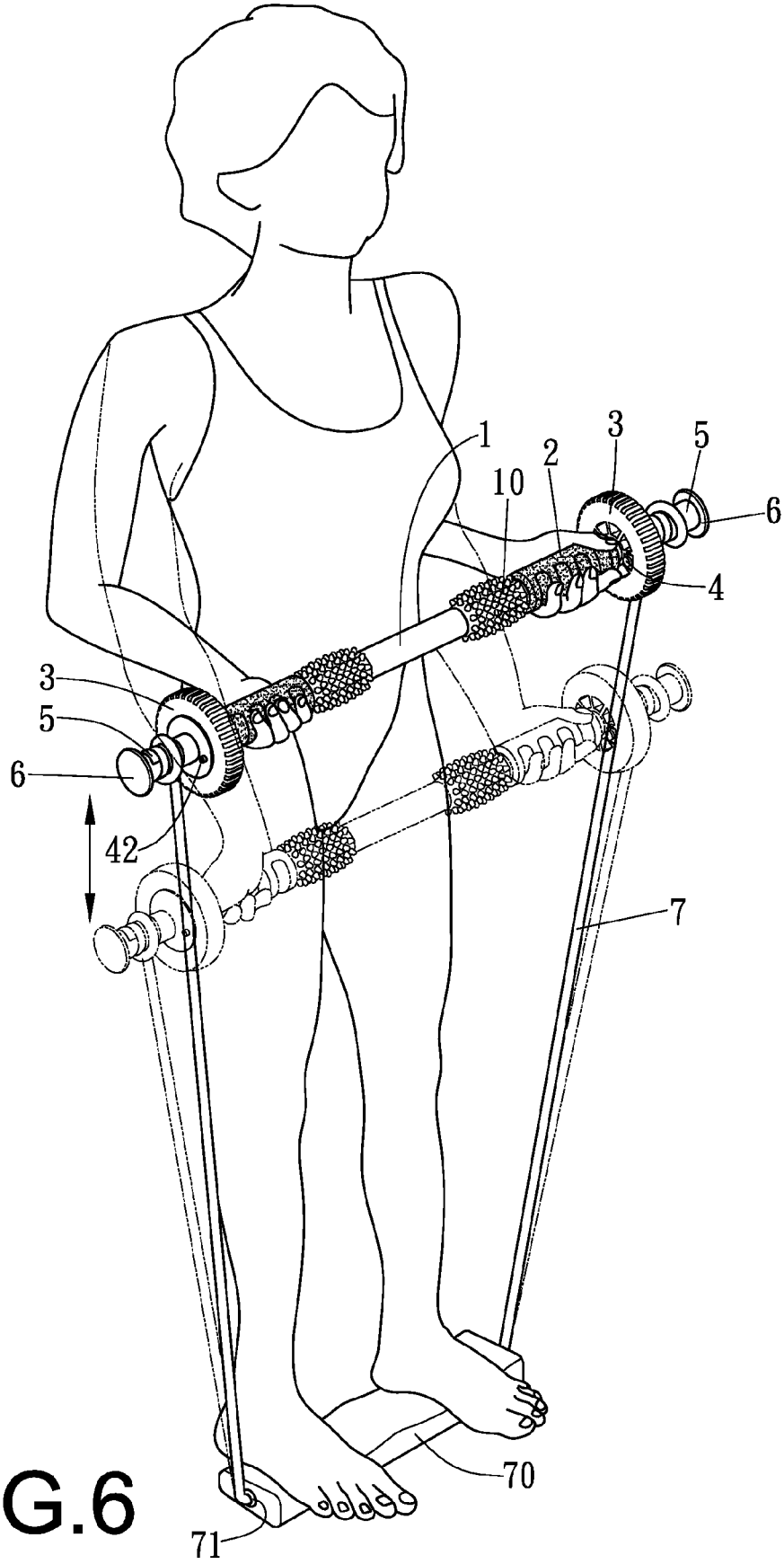
FIG. 6 is a perspective view of the preferred embodiment of a massaging body-gym apparatus in the present invention, showing it being used by a user standing up.
Figure 7:
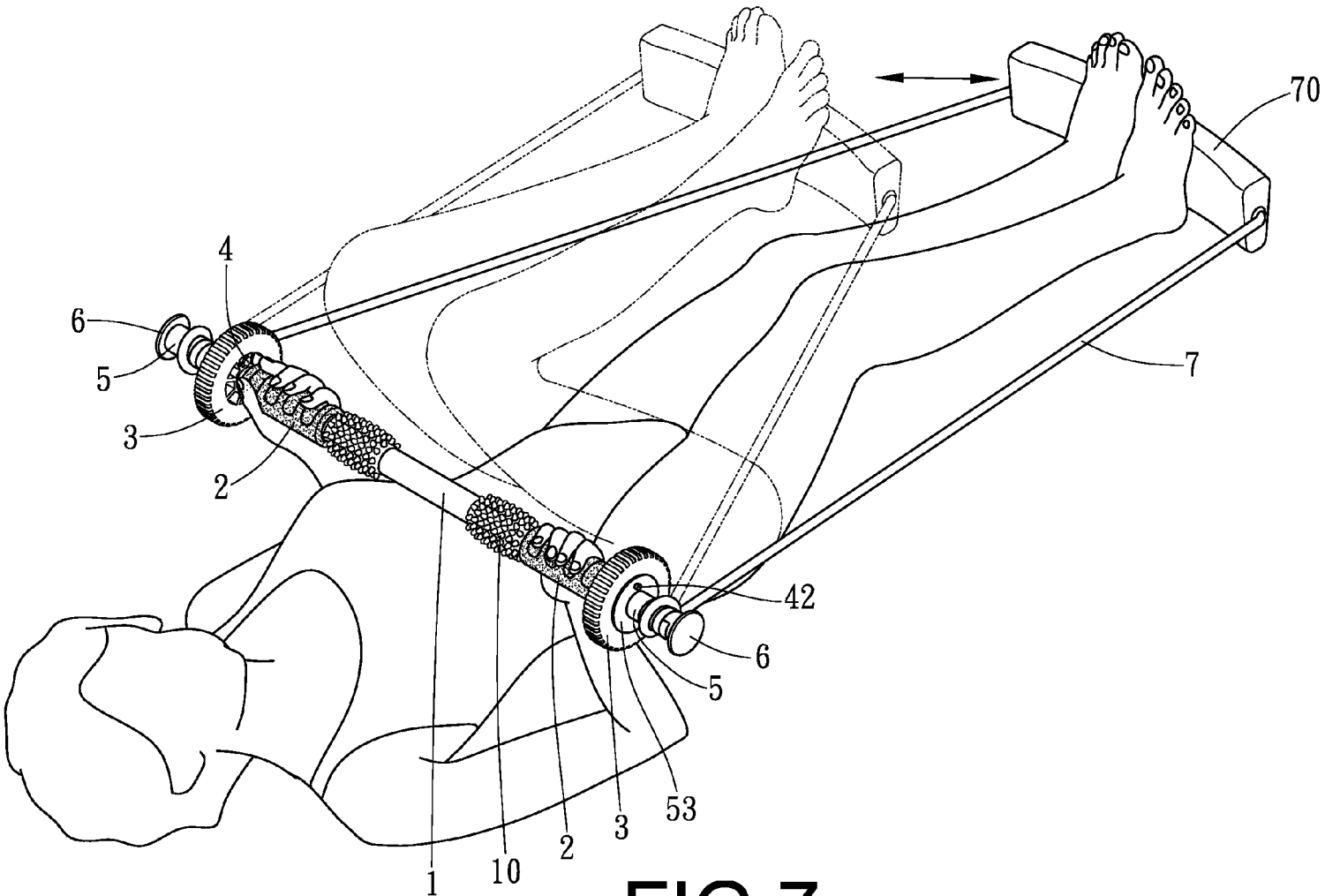
FIG. 7 is a perspective view of the preferred embodiment of a massaging body-gym apparatus in the present invention, showing it being used by a user stretching legs.
Figure 8:
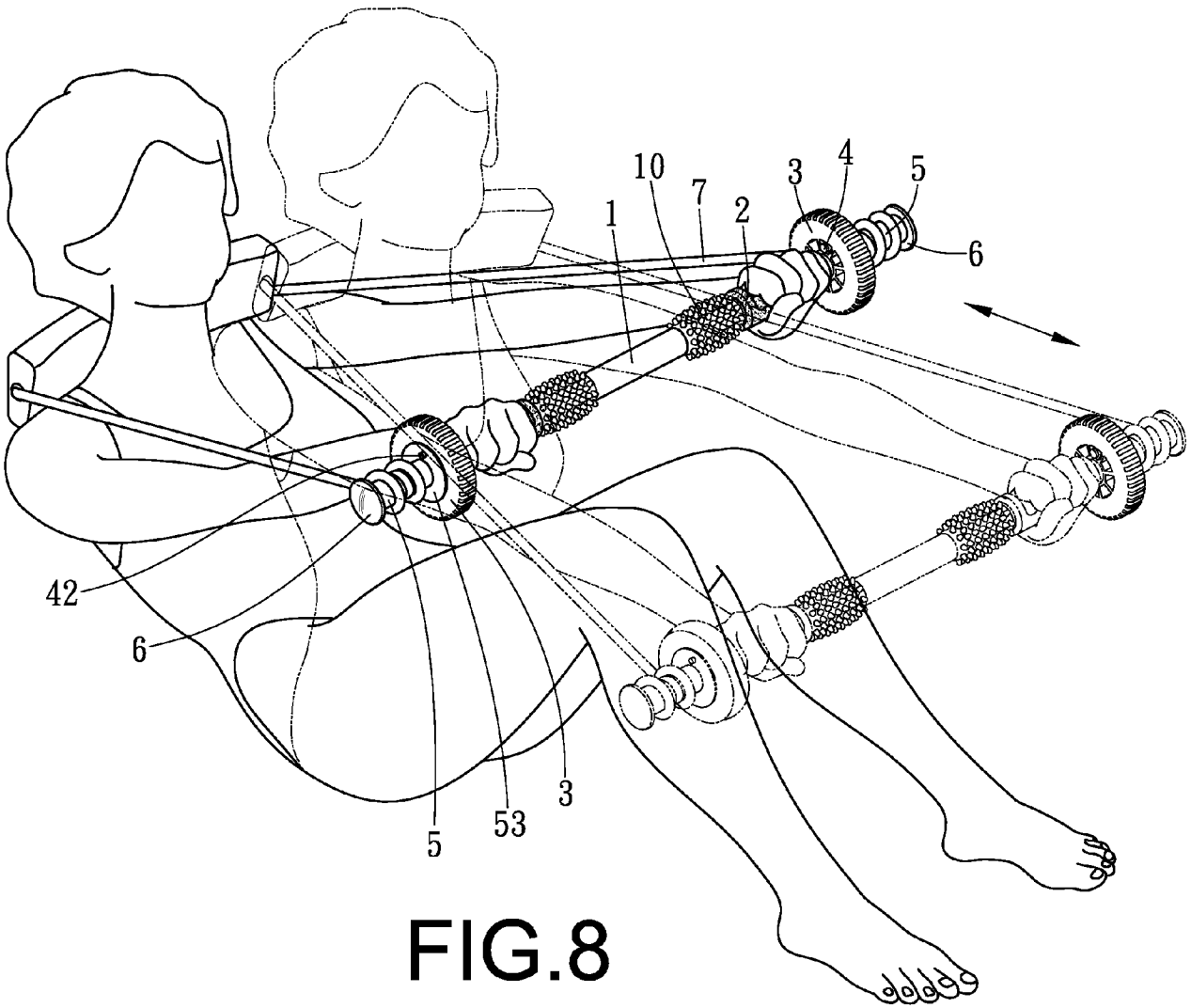
FIG. 8 is a perspective view of the preferred embodiment of a massaging body-gym apparatus in the present invention, showing it being used by a user doing sit-up.
Figure 9:
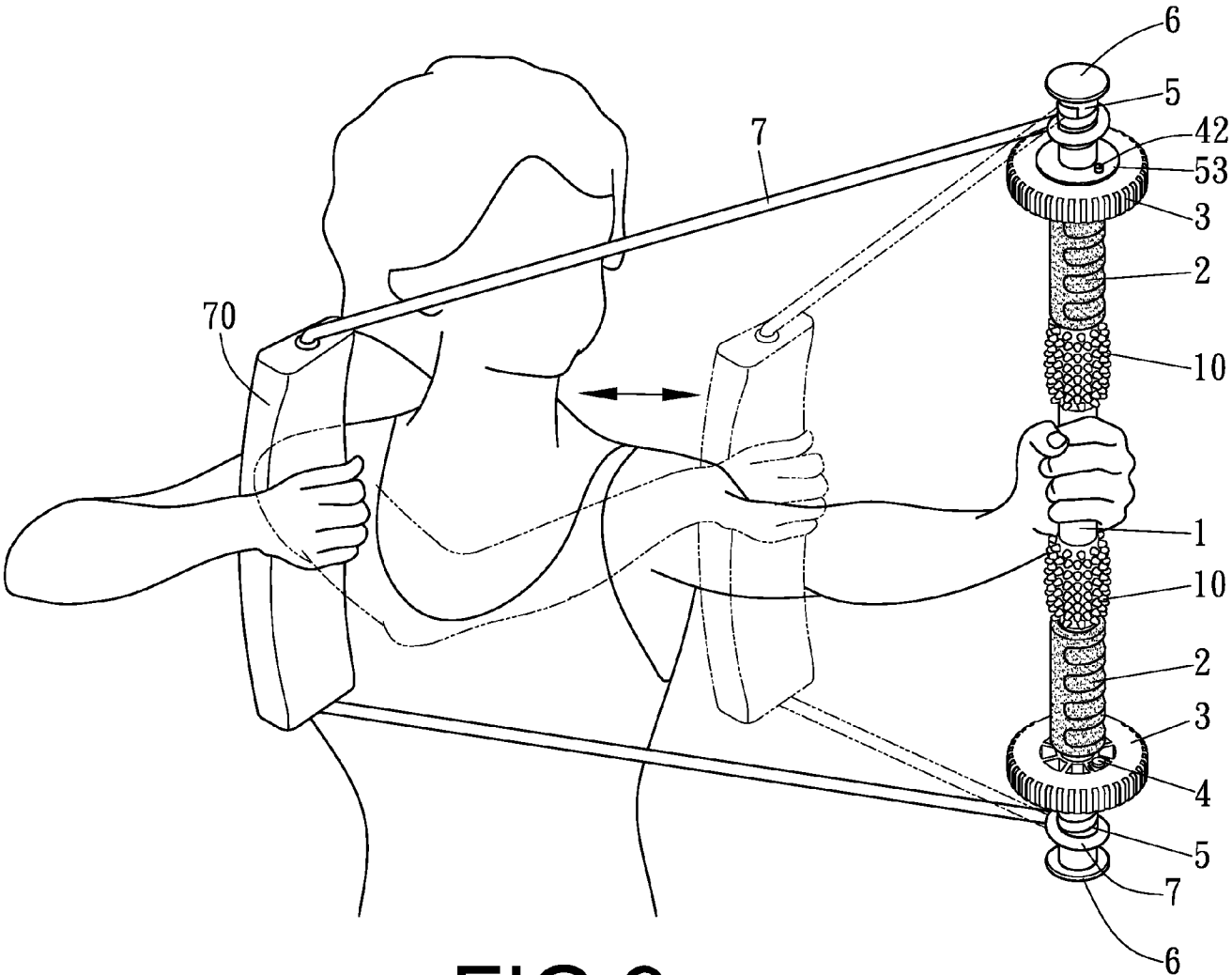
FIG. 9 is a perspective view of the preferred embodiment of a massaging body-gym apparatus in the present invention, showing it being used for chest exercise.
Figure 10:
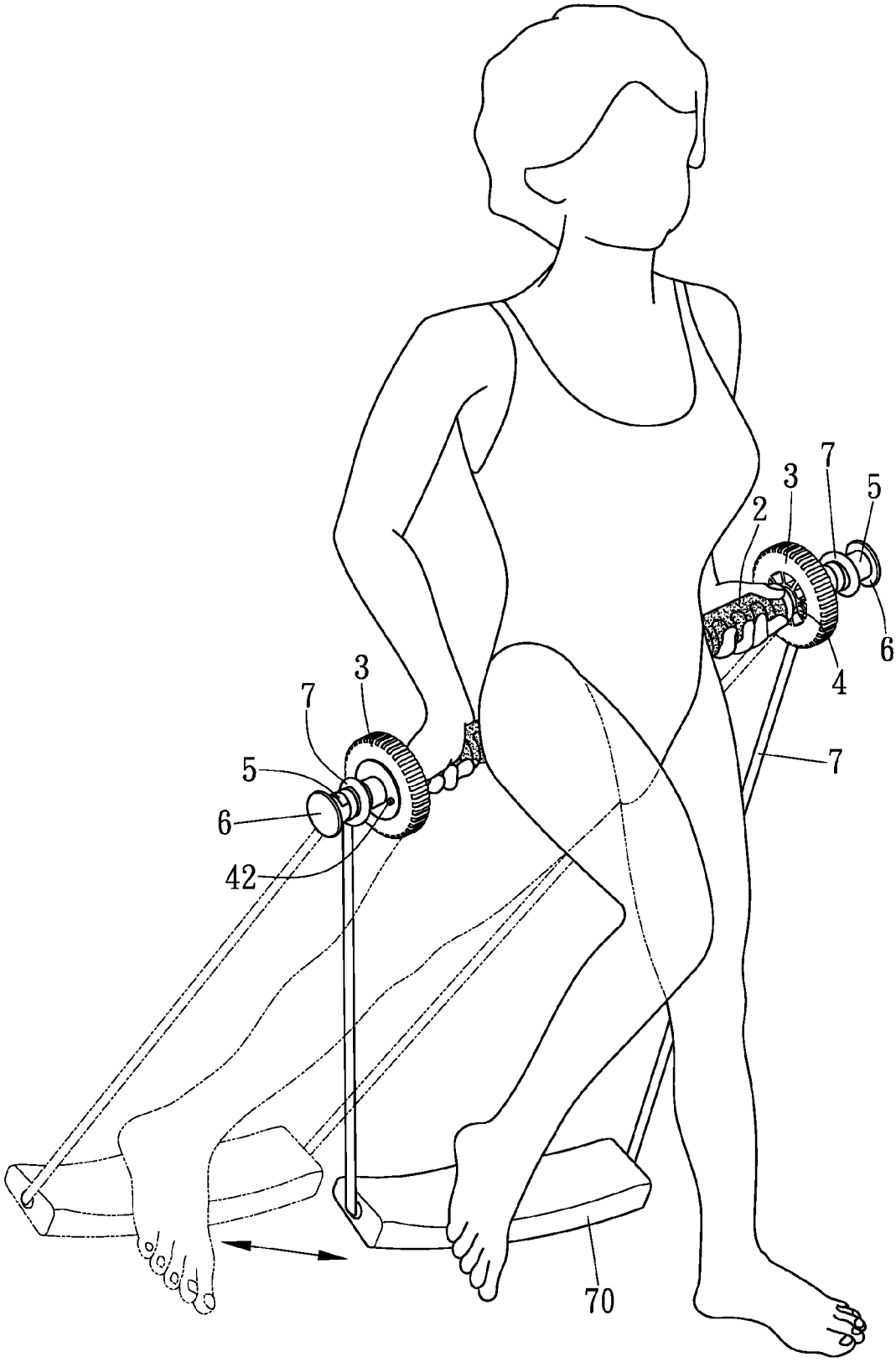
FIG. 10 is a perspective view of the preferred embodiment of a massaging body-gym apparatus in the present invention, showing it being used by a user stretching a leg backward.
Figure 11:
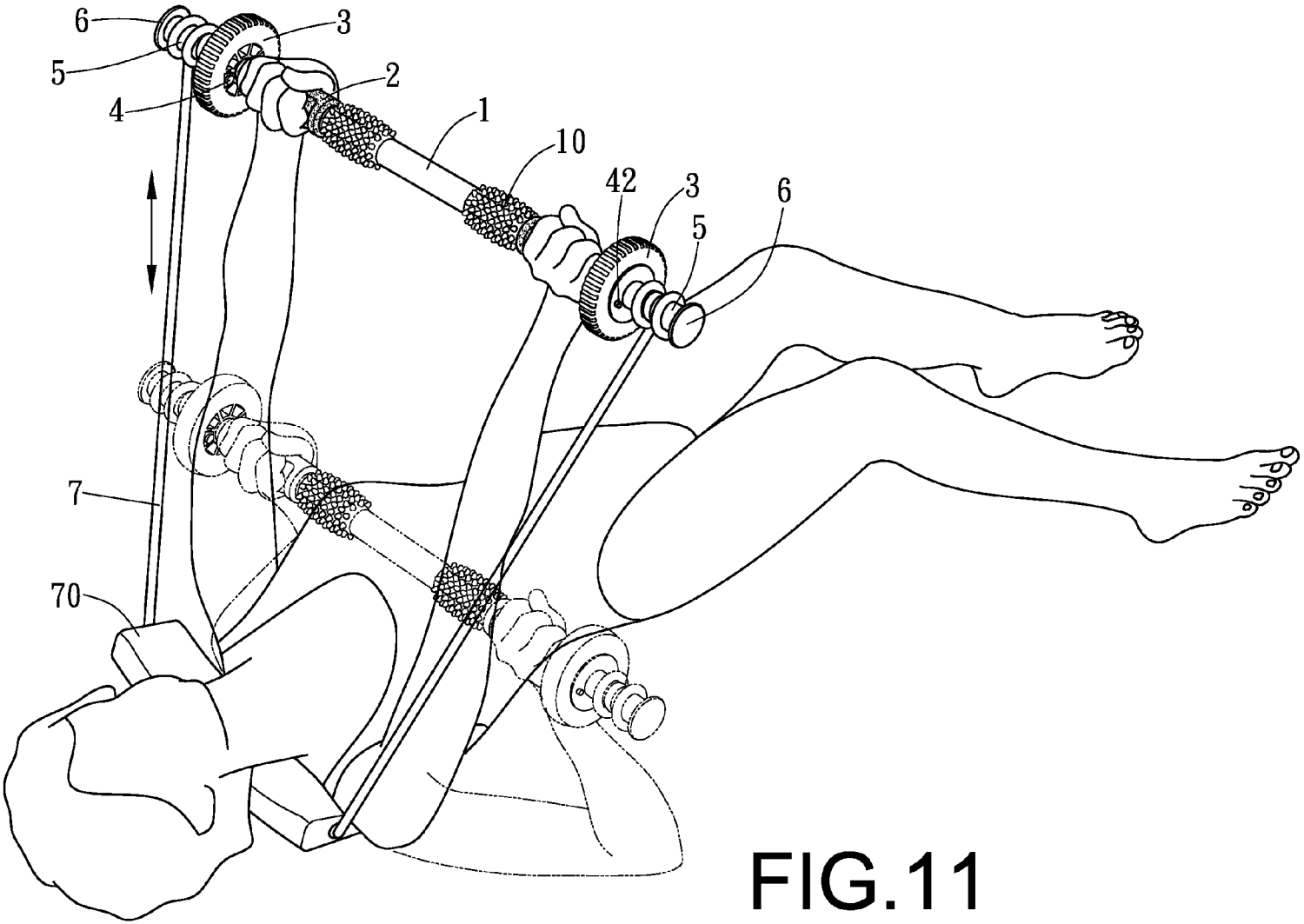
FIG. 11 is a perspective view of the preferred embodiment of a massaging body-gym apparatus in the present invention, showing it being used by a user lying down to stretch arms up.

In using, as shown in FIGS. 6-11, the present invention can be applied for a variety of postures to enable different parts of a body exercised. When the present invention is used merely as a body-gym apparatus, the rollers 3 can be fixed immovably as described below. First, rotate the roller 3 to keep the positioning bar 42 of the positioning device 4 facing just toward the restricting hole 54 of the positioning sleeve 5. Then, push the end 420 of the positioning bar 42 of positioning device 4 to enable the other end of the positioning bar 42 to pass through the restricting hole 54, keeping the roller 3 positioned immovably. The blocking rim 421 of the positioning bar 42 is moved to contact tightly with a smaller diameter of the sliding grooves 400 and 410 as the inner walls of the sliding grooves 400 and 410 are formed conical, so as to prevent the positioning bar 42 from moving freely. And, the present invention is ready for use. As shown in FIG. 6, a user can stand on the supporting cushion 70 and grasp the grip 2 of the rod 1 with two hands to drag the elastic rope 7 up and down to do exercise for arms. As shown in FIG. 7, the user can lie down, holding the grip 2 of the rod 1 with two hands and the supporting cushion 70 with two feet; then, the user can bend and stretch his legs to do exercise for his legs. As shown in FIG. 8, the user can lie down with legs slightly bent and put the supporting cushion 70 of the elastic rope 7 against the back of his neck and grasp the grip 2 of the rod 1 with two hands; then, via dragging the elastic rope 7, the user can do sit-up to exercise his abdomen. As shown in FIG. 9, the user can hold the rod 1 with one hand and the supporting cushion 70 with the other one; then, keep the hand holding the rod 1 stretched and the other one bent to drag the elastic rope 7 for chest exercise. As shown In FIG. 10, the rod 1 is put behind the user and grasped by two hands; one leg steps on the supporting cushion 70, bending backward slightly, and then starts to stretch the leg backward to drag the elastic rope 7, beneficial to diminish proud flesh to have a good shape. And, as shown in FIG. 11, the user can lie down, putting the supporting cushion 70 of the elastic rope 7 just behind his neck and holding the grips 2 of the rod 1 with two hands; then, start to stretch and bend arms up and down for virtual weight-lifting.

Figure 12:
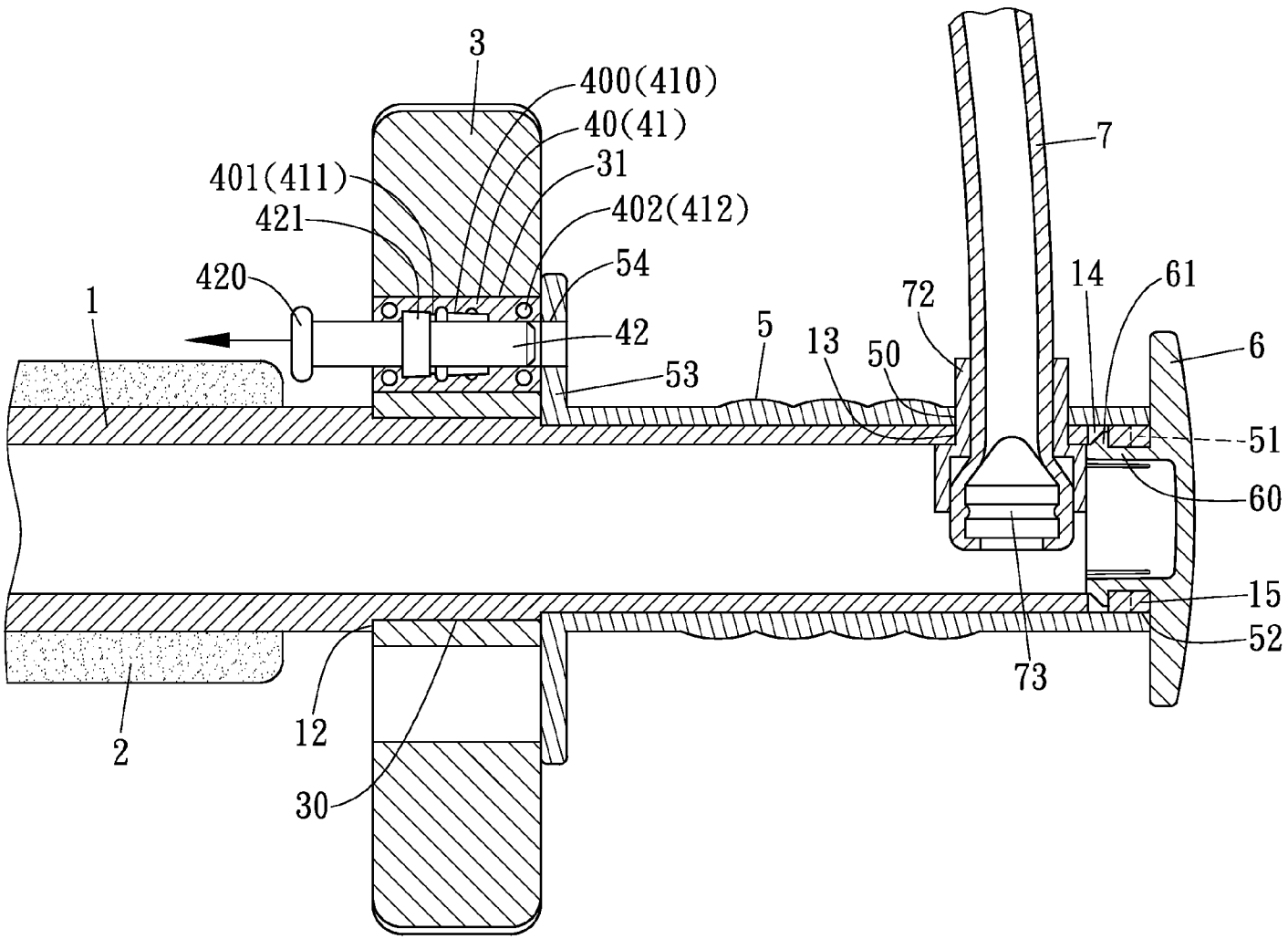
FIG. 12 is a partial cross-sectional view of the preferred embodiment of a massaging body-gym apparatus in the present invention, showing a positioning bar separated from a restricting hole of a blocking disc.
Figure 13:
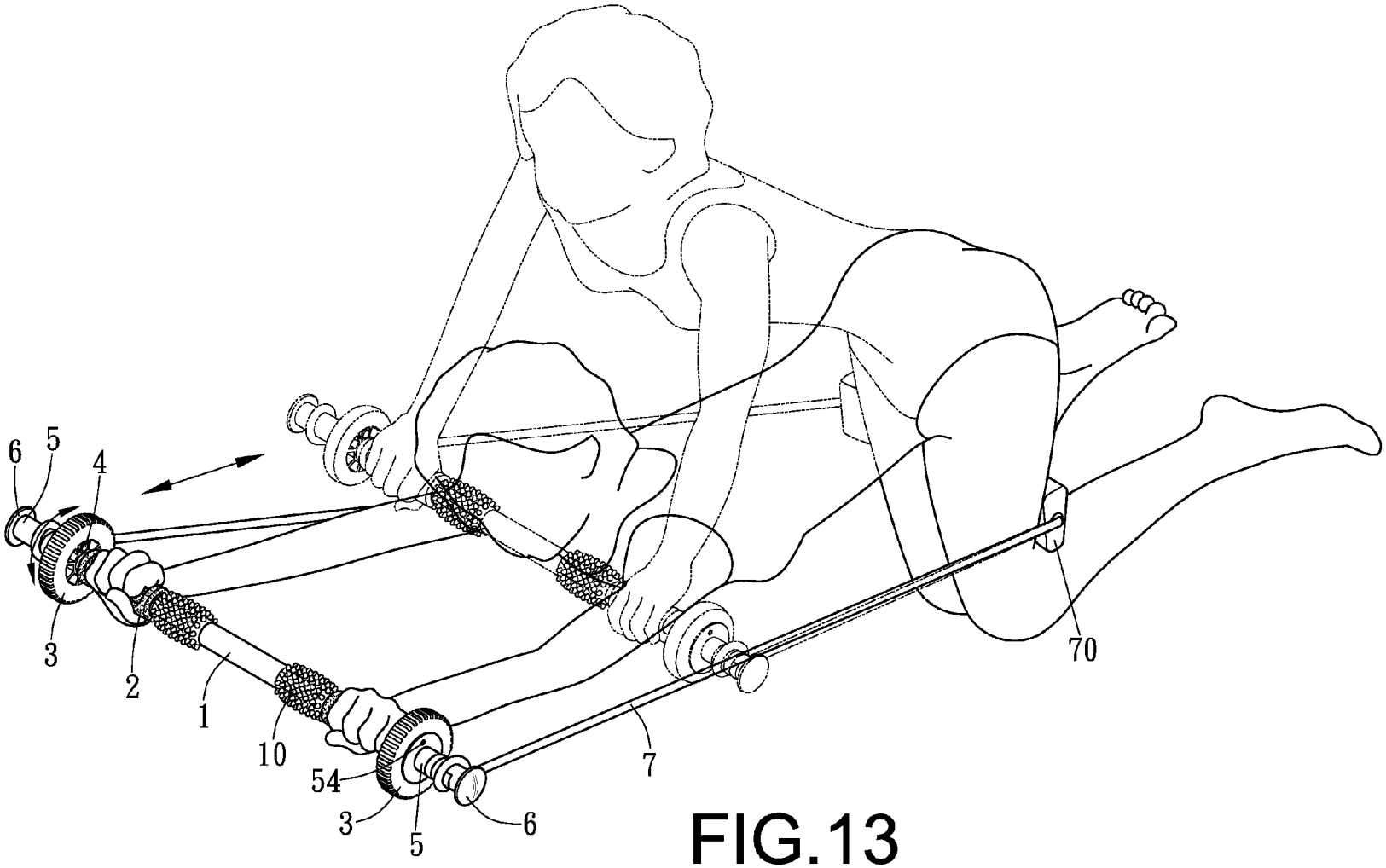
FIG. 13 is a perspective view of the preferred embodiment of a massaging body-gym apparatus in the present invention, showing it being moved to and fro on the ground.

As shown in FIG. 12, when the roller 3 is expected to be used, a user has just to pull back the positioning bar 42 of the positioning device 4 to keep the other end of the positioning bar 42 separated from the restricting hole 54 of the positioning sleeve 5, so that the roller 3 is able to rotate freely without restriction. The blocking rim 421 is moved back to a larger diameter of the sliding grooves 400 and 410 and restricted by the semi-annular rims 401 and 411 to stay immovably thereof; so, it is not to move forward to the blocking disc 53 while the roller 3 is rotating. The rollers 3 can be used as shown in FIG. 13, so a user can kneel down, put the supporting cushion 70 of the elastic rope 7 just behind the knees and hold the grips 2 of the rod 1 with two hands to keep the rollers 3 touching on the ground; then, the user can move his body to make the rollers 3 whirl to and fro to exercise the arms and the belly.

Figure 14:
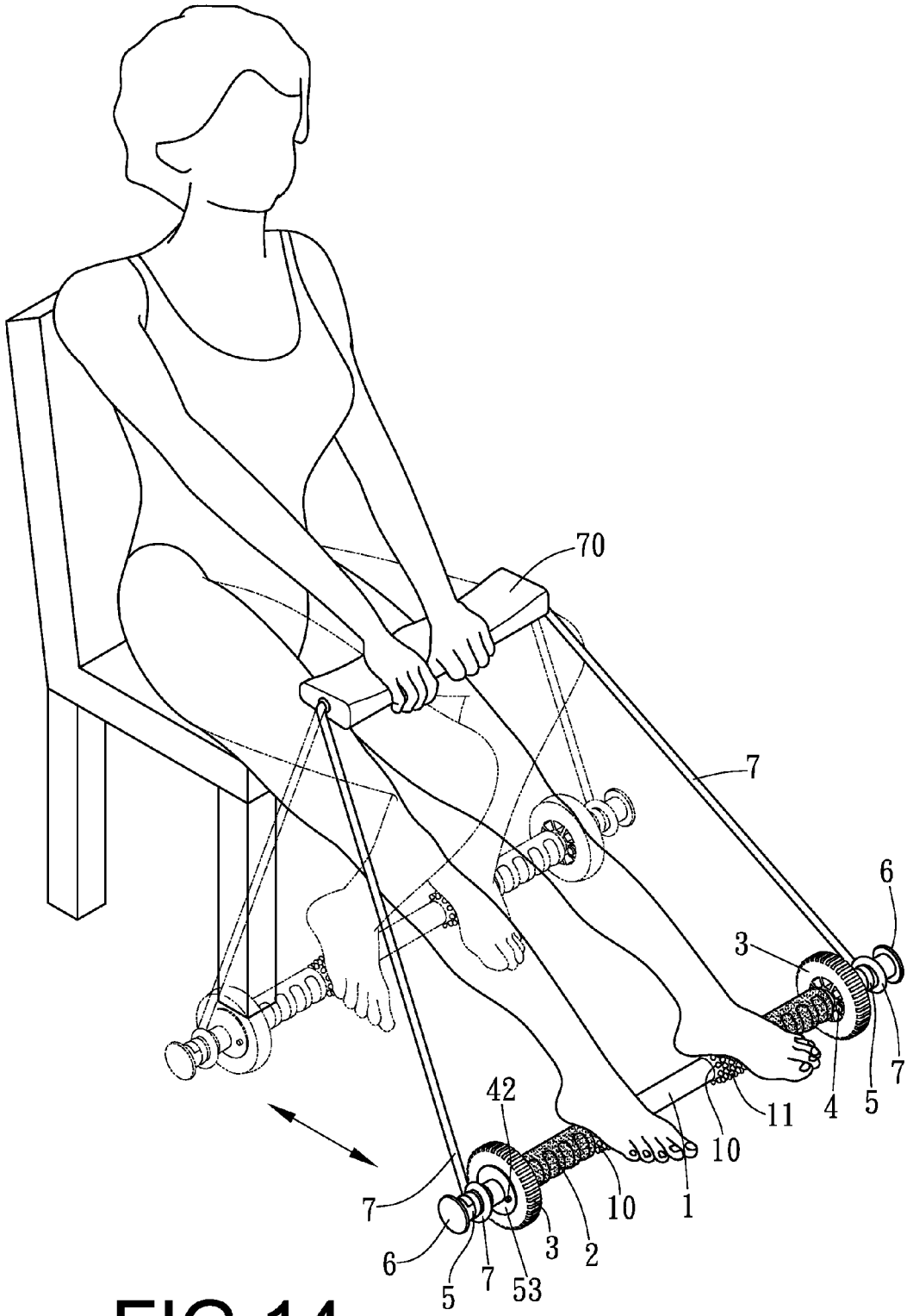
FIG. 14 is a perspective view of the preferred embodiment of a massaging body-gym apparatus in the present invention, showing it being used to massage feet.

When the present invention is to be used for massaging, a user can keep the massaging body 10 of the rod 1 attached and whirled on the part to be massaged, so that the massaging particles 11 of the massaging body 10 can knead the muscles and the acupuncture points. As shown in FIG. 14, if the feet are to be massaged, a user can sit on a chair, stepping on the massaging bodies 10 and holding the supporting cushion 70 of the elastic rope 7 with hands; then, move the legs to and fro to keep the rollers 3 moved to let the feet massaged by the massaging particles 11 of the massaging bodies 10.

In addition, if the elastic rope 7 is too long, it can be wrapped around the positioning sleeves 5 to have a proper length. And, the elastic rope 7 can be isolated by the blocking disc 53 of the positioning sleeve 5 to prevent it from tangling the roller 3. Conclusively, the present invention can not only be used with diverse postures to exercise and massage almost all parts of a body, but also be handily carried for use any time as it is small and light. Moreover, the present invention can save the expense of buying various body gyms and massaging devices.

While the preferred embodiment of the invention has been described above, it will be recognized and understood that various modifications may be made therein and the appended claims are intended to cover all such modifications that may fall within the spirit and scope of the invention.

What is claimed is:

1. A massaging body-gym apparatus comprising:

a rod provided with plural massaging bodies, a blocking rim formed near the two ends of said rod respectively, a through hole bored outside said blocking rim, said massaging bodies provided with a plurality of massaging particles formed on its surface;

at least two rollers mounted on said rod and respectively provided with plural through holes;

two positioning sleeves respectively mounted at said two ends of said rod and provided with a through hole and a blocking disc located at one end;

two sealing covers respectively connected to two ends of said rod;

an elastic rope having its two ends respectively connected to two ends of said rod; and said massaging body-gym apparatus characterized by that a positioning device is installed in one of said through holes of each roller and provided with a pair of half positioning bases and a positioning bar, and said blocking disc of said positioning sleeve is provided with a restricting hole to be inserted by said positioning bar.

2. The massaging body-gym apparatus as claimed in claim 1, wherein a grip is wrapped around said rod outside each of said massaging bodies.

3. The massaging body-gym apparatus as claimed in claim 1, wherein said elastic rope is provided with a supporting cushion located at its center, a sleeve formed at two ends of said supporting cushion respectively, a soft jacket fixed at its two ends respectively, and a block inserted in said soft jacket.

4. The massaging body-gym apparatus as claimed in claim 1, wherein said half positioning bases of said positioning device are respectively provided with a sliding groove having a conical inner surface, a semi-annular rim formed inside said sliding groove and a positioning pin located on their outer surface, and said positioning bar is wrapped by said half positioning bases to be able to slide therein and provided with an end having a larger diameter, and a blocking rim to be positioned in said sliding grooves of said half positioning bases.

* * * * *